United States Patent [19]

Kula

[11] 4,202,478

[45] May 13, 1980

[54] STOCK CHECK AND LEAD-IN ROLL ASSEMBLY

[75] Inventor: Bernard Kula, Woonsocket, R.I.

[73] Assignee: Cooper-Weymouth, Peterson, Inc., Esmond, R.I.

[21] Appl. No.: 960,847

[22] Filed: Nov. 13, 1978

[51] Int. Cl.[2] ..... B65H 23/10; B65H 23/26

[52] U.S. Cl. ..... 226/189; 226/190; 226/194; 226/195; 242/75.2; 242/76

[58] Field of Search ..... 226/195, 199, 194, 196, 226/168, 180, 190, 21, 22, 189; 242/75.2, 76

[56] References Cited

U.S. PATENT DOCUMENTS

| | | | |
|---|---|---|---|
| 1,140,460 | 5/1915 | Jaeger | 226/195 X |
| 2,067,755 | 1/1937 | Dyer, Jr. | 242/75.2 X |
| 2,774,593 | 12/1956 | Lewis et al. | 242/75.2 X |
| 2,842,361 | 7/1958 | Miller | 226/21 |
| 3,289,908 | 12/1966 | Engle | 226/195 |

*Primary Examiner*—George F. Mautz
*Attorney, Agent, or Firm*—Salter & Michaelson

[57] ABSTRACT

Lead-in apparatus for positioning sheet stock for feed along a generally straight path to an intermittent operation press or the like, including a lead-in roll assembly and a stock brake assembly to respectively maintain the stock relatively steady and provide it with a frictional drag as it advances towards the press. The lead-in roll assembly includes a first roll over which the stock is adapted to pass and a second roller under which the stock passes. The second roller is journaled between the spaced arms of a bracket pivotally mounted on the axis of the first roller whereby the height of the second roller may be readily adjusted relative to the first roller and the strip stock passing therebetween. The brake assembly includes upper and lower friction brakes which impart the desired frictional drag to the sheet stock when positioned in their closed attitude. The brakes are mounted upon upper and lower check bars, the upper check bar being normally biased downward into its closed operative position by spring means, but being movable to and maintainable in an upper open position by actuation of a lever assembly associated therewith.

11 Claims, 6 Drawing Figures

FIG. 1
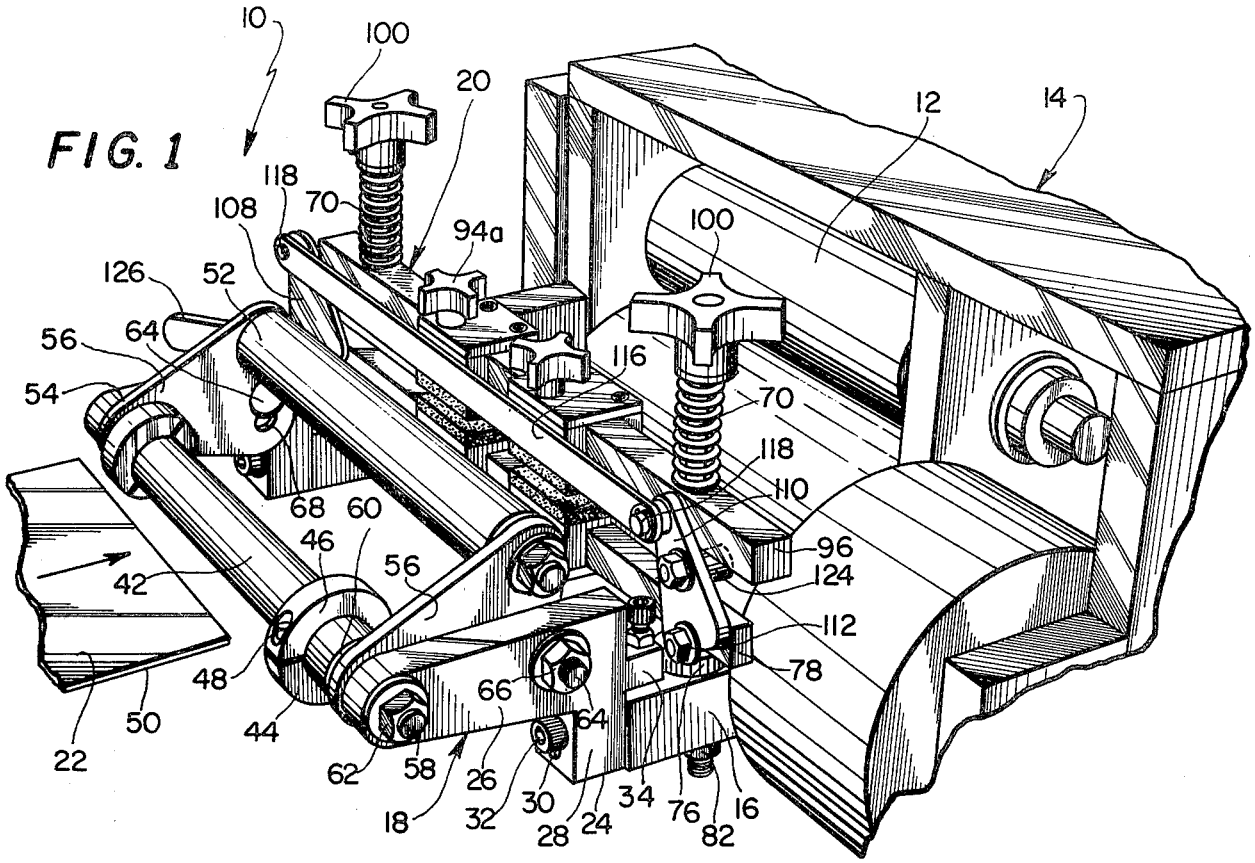
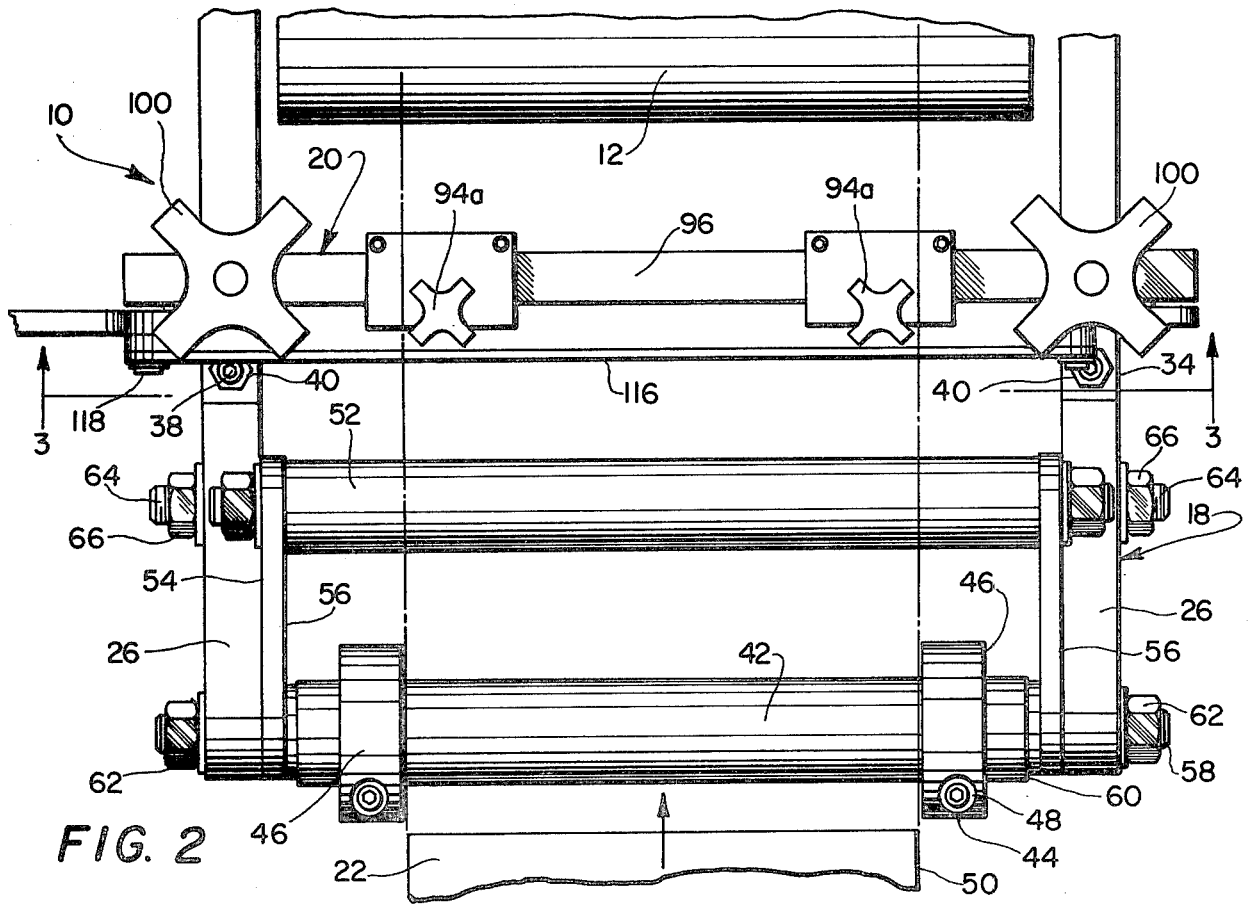
FIG. 2

FIG. 3
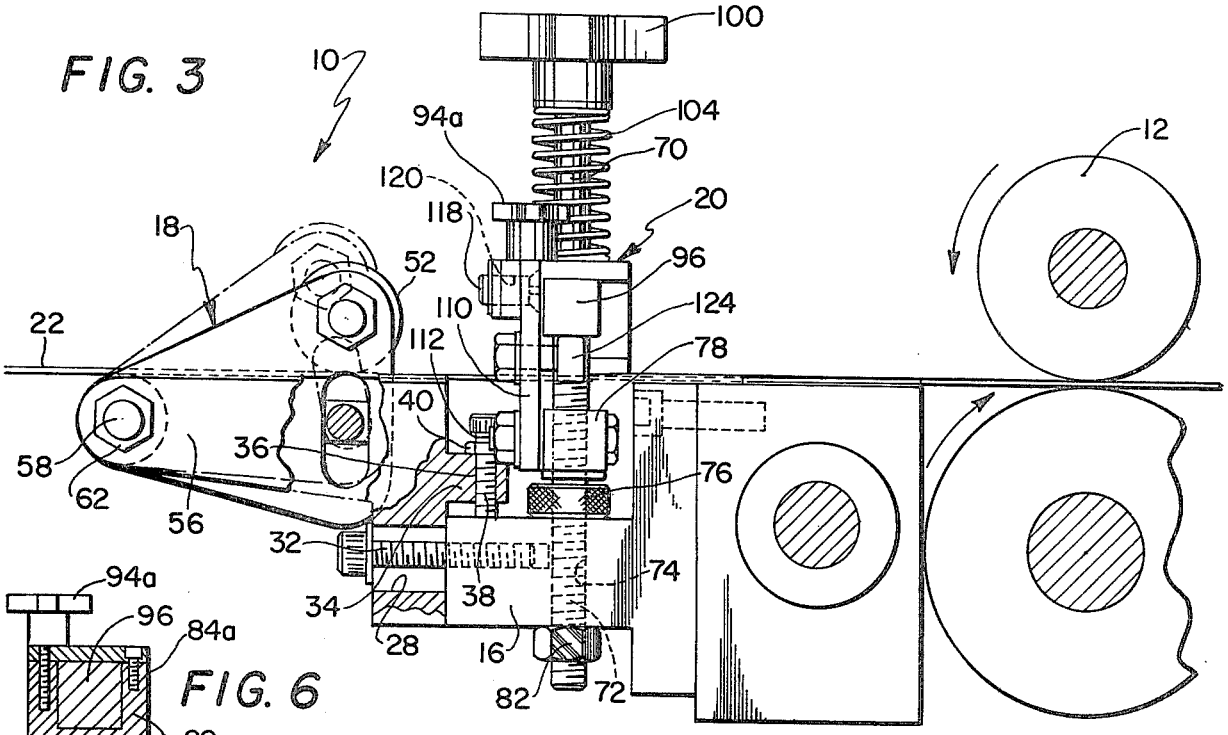
FIG. 6
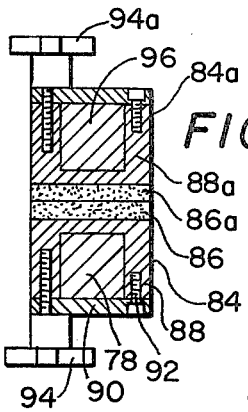
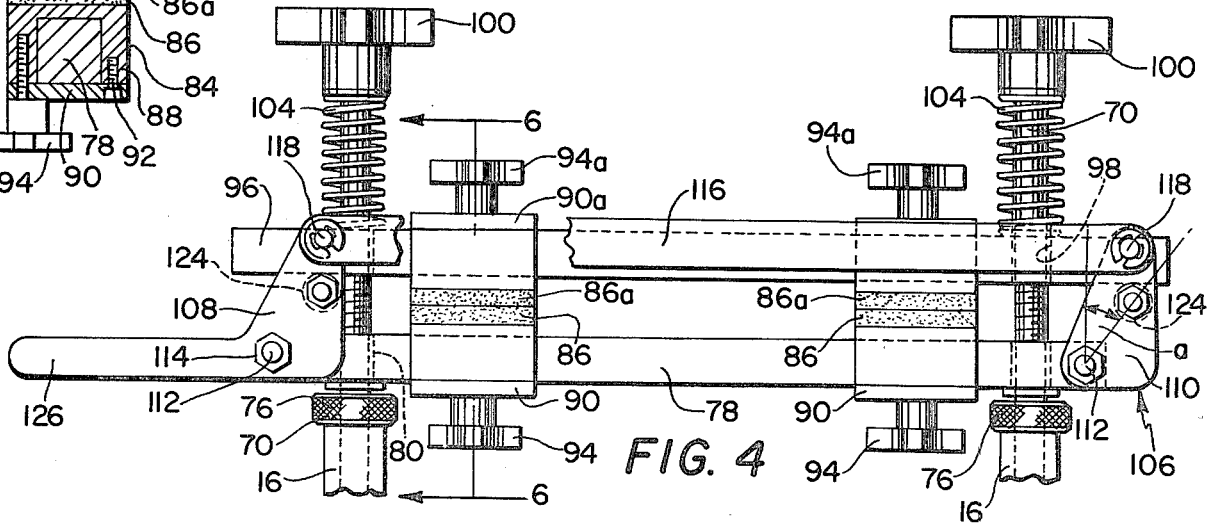
FIG. 4
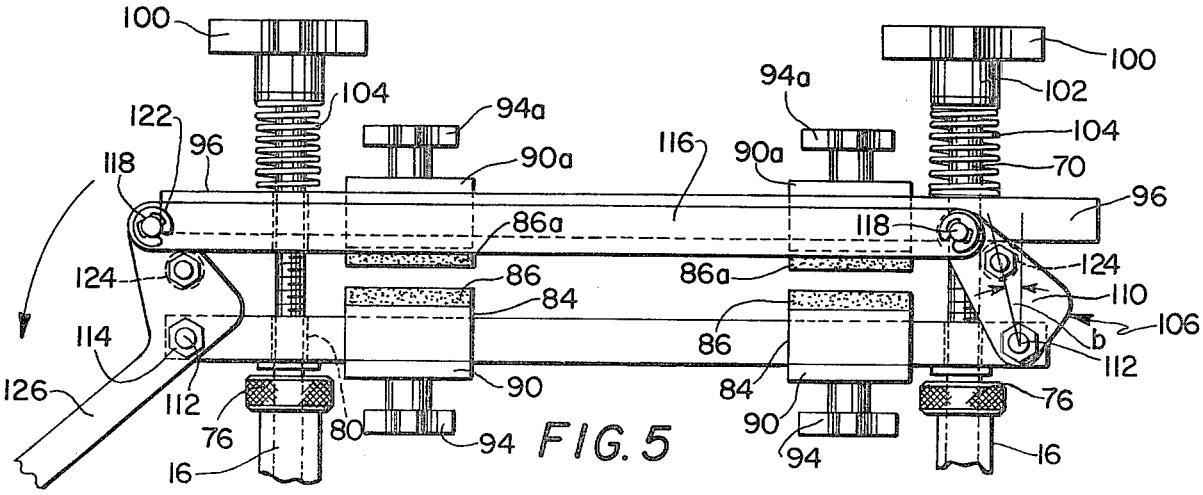
FIG. 5

STOCK CHECK AND LEAD-IN ROLL ASSEMBLY

BACKGROUND AND SUMMARY OF THE INVENTION

This invention relates to feed mechanisms for power presses such as stamping presses and the like and particularly to a lead-in apparatus such that the strip stock entering the feed mechanism may be properly oriented, positioned and stablized. Generally, feed devices of this nature include a pair of spaced rollers, which impart a predetermined linear movement to strip stock in timed sequence to the operation of the press. An example of such an intermittent strip roll feed device is shown in U.S. Pat. No. 3,907,188, issued Sept. 23, 1975. It is desirable when moving stock to feed devices of this nature that the stock be relatively steady, that is, that it not be subject to undue wide variations in lateral or vertical movement or undesirable whipping action. It is further desirable that the stock be subject to a constant frictional drag so as to eliminate overfeed due to the momentum of the stock and the like.

Accordingly, it is an object of the present invention to provide a lead-in assembly for use in conjunction with press feed devices which accomplish the above-indicated objectives in an efficient and straightforward manner.

These and other objects of the present invention are accomplished by the provision of a lead-in apparatus including a lead-in roll assembly and a stock brake assembly positioned forwardly, that is, upstream of the feed rolls of an associated press. The lead-in roll assembly insures the proper orientation of the stock while simultaneously essentially eliminating undesirable vertical or lateral movements thereof by directing such stock sequentially over a first roll and then under a second roll. The second roll is disposed downstream of the first roll and is adjustable towards and away from the stock by reason of its support between spaced arms of a bracket pivotally supported about the rotational axis of the first roller. The brake assembly, which includes at least a pair of opposed stock brakes, is positioned immediately downstream of the lead-in roll assembly. An upper brake is mounted on an upper stock check bar, which in turn is normally biased toward a lower brake to impart the desirable amount of frictional drag to the stock as it passes therebetween. A lever assembly is associated with the upper check bar such that it may be moved against the action of the biasing means to an open position so as to release the frictional drag on the stock and enable the stock to be hand fed when necessary or desirable. Adjustment means are provided so as to ensure proper alignment of the stock as it passes from the roll assembly to the stock brake assembly.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 1 is a perspective view showing the lead-in and brake apparatus of the present invention positioned forwardly of the feed rolls of a press feeding device, FIG. 2 is a top plan view thereof.

FIG. 3 is a side elevational view thereof.

FIG. 4 is a front elevational view thereof with the lead-in assembly removed and showing the stock brake assembly in its normal closed position wherein it frictionally engages the stock passing therethrough.

FIG. 5 is a front elevational view similar to FIG. 4 but showing the stock brake assembly in an open position.

FIG. 6 is a sectional view taken along the line 6—6 in FIG. 4 showing the construction of the stock checks.

DESCRIPTION OF THE INVENTION

Referring now to the drawings, it may be seen that the lead-in assembly 10 of the present invention is adapted for positioning forwardly and in line with a pair of feed rolls 12 of a press roll feeding device 14 which includes frame portions 16 on which the lead-in assembly 10 is positioned. The lead-in assembly 10 in turn includes a lead-in roll assembly 18 and a stock brake assembly 20. Stock 22 in the form of sheet metal strip payed out from any suitable storage roll or the like is adapted to progressively pass through the lead-in roll assembly 18, the stock brake assembly 20 and then to the feed rolls 12 of the press roll feed device 14.

The lead-in roll assembly 18 includes a carriage 24 formed from a pair of laterally spaced flanges 26. The orientated slot 30 through which the carriage may be fixedly connected to the frame 16 yet vertically adjustable therewith by means of bolts 32. The rear surface of the carriage 24 includes an extension 34 having a vertically orientated threaded bore 36 disposed therethrough for receipt of a threaded adjustment bolt 38. Accordingly, by turning the adjustment bolt 38 and thereafter tightening the lock nut 40 while the bolt 32 is somewhat loose and thereafter tightening bolt 32, proper vertical positioning of the carriage 24 with respect to the frame 16 may suitably be arrived at as by the use of levels, measures and the like.

A first roller 42 is suitable rotatably journaled between the ends of the flanges 26, and it is over this roller that the stock 22 is adapted to pass. Accordingly, the height of the carriage 24 is normally adjusted such that the upper surface of the roller 42 is horizontally in line with the level of the nip of the feed rollers 12, such that the stock 22 may thereafter be directly moved in a straight line to such feed rolls. The terms horizontal and vertical are used herein in their broad sense to describe not only actual positions or directions but relative positions and directions as well, as when the plane of stock movement is orientated at an angle other than 180 degrees with respect to the press roll feeding device 14 or some other reference point. Lateral edge stock guide means in the form of a pair of laterally spaced collars 44 are positioned on the first roll 42. Such collars include a generally C-shaped body clamp 46 and fastening means in the form of a bolt 48 such that the body may be frictionally clamped to the roller 42 in various laterally adjustable locations. In this way, then, the collars 44 may be adjusted such that the lateral edges of 50 of the stock 22 engages the inside surfaces of the clamps 44 in such a way that the sheet is restrained from lateral movement while passing over the roller 42.

The roll assembly 18 further includes a second roller 52 positioned downstream and above the first roller 42 such that the stock 22 may pass therebeneath in contact with lower surface portions thereof. The second roller 52 is mounted on a bracket 54 including a pair of laterally spaced arms 56. The bracket 54 is pivotally supported on the rotational axis of the first roller 42 as by passage of the rod 58 through openings provided at the arm ends proximal thereto and by the disposition of such ends between the flanges 26 and the butt end surfaces 60 of the roller 42. Nut 62, when tightened, serves to position the first roller 42 and the bracket 54 in the aforementioned relationship. The bracket 54 is thus arcuately pivotal about the rod 58, and accordingly the second roll 52 may be vertically adjusted so as to accommodate the passage of various thickness of stock material between the two rollers 42 and 52 while maintaining the passage of the stock 22 within a straight line plane from the roll assembly 18 to the nip of the feed rolls 12 of the press roll feeding device 14. As best shown in FIG. 3, the height at which the second roller 52 is positioned may be achieved by the tightening of bolts 64 by means of nuts 66. The bolts 64 are adapted to pass through vertically orientated slots 68 provided through each of the arms 56 of the bracket 54 and then in turn through an opening in each of the flanges 26. In this fashion then, the position of the second roller 52 may be fixed in relationship to the the second roller 52 may be fixed in relationship to the first roller 42 so that the stock 22 may engage the top surface of roll 42 and the bottom surface of roll 52 while being maintained in a straight line path, i.e., the spacing between the top of roll 42 and the bottom of roll 52 is approximately equal to the thickness of the stock 22. It will thus be apparent that the roll assembly 18 serves to dampen or eliminate most vertical and lateral movement of the sheet 22, whereby the stock moves in a smooth, controlled manner as it approaches the rolls 12.

The stock brake assembly 20 is located immediately adjacent the lead-in roll assembly 18 on the downstream side thereof. Its function is to apply a frictional drag upon the sheet 22 as it is fed into the press 14. Such assembly 20 includes a pair of laterally spaced, vertically orientated posts 70, the lower ends 72 thereof being threaded such that the posts 70 may be connected to the frame 16 by reason of their disposition in threaded bores 74 thereof. A lower check bar 78 is mounted on the posts 70 which pass through bores 80 provided therein. A knurled adjustment nut 76 is threadably connected to each post and disposed between the frame 16 and the lower check bar 78 such that the height of such check bar may be varied. The height at which the posts 70 extend above the frame is fixed by the degree to which they are threaded into the bores 74 and such position is fixed by lock nuts 82. A pair of stock checks are clamped to the lower bar 78 such that the upper surfaces of a brake pad 86 connected to check 84 is disposed in contact with lower surface portions of the stock 22 as it passes thereover.

The stock checks 84 include a generally U-shaped body 88 (see FIG. 6) adapted to partially encircle the bar 78 and keeper plate 90 connected thereto by a bolt 92 positioned through an opening at one end of the plate and passing into a threaded bore provided in the body 88. The other end of the keeper plate 90 is provided with an opening through which a clamping member 94 may be inserted which also passes into a threaded bore in the body 88 such that upon tightening of the clamping member 94 the stock check 84 is securely clamped to the bar 78. Loosening of the clamps 94 and sliding the stock checks 84 along the bar 78 enables the stock checks to be positioned in various lateral positions therealong.

An upper stock check bar 96 is positioned above the lower stock check bar 78 by the passage of the posts 70 through a pair of vertically orientated unthreaded bores 98 provided therein. A pair of stock checks 84*a* similar in construction to the stock checks 84 are clamped to the upper bar 96 is a similar fashion. The upper ends of the posts 70 terminate in a handle 100 having a lower boss portion 102 against which a coil spring 104 is disposed. The other end of the coil spring bears against the upper surface of the upper check bar 96. The tension of the spring 104 may be varied by turning the handles 100 so as to threadably adjust the height of the posts 70 so as to compress or relax the spring; and in this fashion the upper bar the upper bar 96 and its stop checks 84*a* is subject to a constantly downwardly directed spring force, which force is variable such that the frictional drag imparted upon the sheet stock 22 by reason of its contact with the brake pads 86 and 86*a* may also be varied.

A lever assembly 106 is provided so as to move the upper bar 96 and, accordingly, the upper stock checks 84*a* from the normal operative position shown in FIG. 4 to an open position, as shown in FIG. 5, wherein stock may be hand fed and the like, where such becomes necessary or desirable for any reason. The lever assembly 106 includes a first lever 108 and an auxilliary lever 110 both of which are pivotally connected at lower points thereof to opposite ends of the lower check bar 78 by means of bolts 112 and retaining nuts 114. Levers 108 and 110 are of generally vertically orientated flat plate-like configuration having a laterally offset upper terminal portion through which the levers are interconnected by means of the connecting link or bar 116 positioned immediately forward of the upper check bar 96. Such connection is accomplished by a pair of pins 118 outwardly extending from the upper surface of each lever 108, 110 and adapted to pass through an opening 120 provided at the opposite ends of the link 116 and held thereby by retaining rings 122.

Each of the levers 108, 110 further includes a follower roller 124 which is rotatably connected to an intermediate body portion thereof, i.e., between the pins 118 and the pivot bolts 112. Such follower rollers 124 are adapted to contact the under surface portions of the upper bar 96 and are accordingly directed rearwardly towards such bar and disposed therebeneath. The primary lever 108 includes a handle or extension 126 such that the lever may be pivotally moved about its pivotal connection 112 so as to simultaneously force both levers 108 and 110 through an arcuate path such that the pivot connections 118 thereof move past top dead center to a stable position on the opposite side thereof but at a lesser angle from the vertical than their original position, that is, angle a is greater than angle b (FIGS. 4 and 5) so that the over center position as shown in FIG. 5 will maintain the followers 124 at a higher level than at the position shown in FIG. 4. In this fashion then the top check bar 96, by virtue of its engagement by the followers 124 will be forced upwardly against the action of spring 104 to the position shown in FIG. 5 of the drawings. This in turn forces the stop checks 84*a* away from the stop checks 84 such that frictional contact between the stock 22 and the brake pads 86 and 86*a* is no longer present. In this position the stock may be freely fed to the feed rolls 12 manually or be removed for stock change or other similar reasons. The limits of arcuate travel of the levers 108, 110 may be regulated by the disposition of the follower rollers 124 vis a vis the upright posts 70. Thus by reference to FIG. 4 of the drawings it may be seen that the follower roller 124 disposed on the left-hand side thereof may contact the left-hand post 70 in the closed position whereas the follower roller disposed on the right-hand side of FIG. 5 of the drawings may contact the right-hand post 70 in an open position. In both of the positions as shown in FIGS. 4 and 5, the spring 104 serves to exert a continual downward force such that the various members are stabilized in their illustrated positions.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A lead-in apparatus for positioning sheet stock for feed along a straight generally horizontally oriented feed plane to a device such as a press or the like, including a stock brake assembly positioned forwardly of said device, said stock brake assembly comprising upper and lower stock checks disposed respectively above and below said feed plane with said lower stock check restricted from movement towards or away from said feed plane, said upper stock check in turn supported by an upper stock check bar positioned above said feed plane for movement towards and away therefrom such that stock may be braked by opposed contact with said stock checks, spring means for normally urging said upper bar towards said feed plane to a closed stock check attitude, levers positioned on laterally opposite sides of said feed plane, said levers pivotally supported at one point thereof, follower rolls disposed on said levers at a position above said pivot points and adapted to contact said upper stock check bar whereupon pivotal movement of said levers so as to move said followers radially upward forces said upper bar and accordingly said upper stock checks to an open stock check position against the action of said spring means.

2. The apparatus of claim 1, wherein said levers move said followers through a top dead center position in relationship to the pivot points thereof.

3. The apparatus of claim 1, including a link bar transversely extending over said stock plane and connecting said levers for simultaneous movement and handle means associated with one of said levers for actuating said lever movement between said open and closed stock check position.

4. The apparatus of claim 1, wherein said device includes a frame on which said stock brake assembly is supported, said stock brake assembly including a lower stock check bar, upright posts supported from said frame and positioned on laterally opposite sides of said feed plane, said stock check bars supported on said posts with said lower bar positioned in relative fixed position thereto and said upper bar slidable up and down with respect thereto, said spring means including a coil spring encircling each of said posts and having one end thereof contacting upper surface portions of said upper bar and means at the upper ends of said posts contacting said other ends thereof for changing the tension of said spring.

5. The apparatus of claim 4, said stock checks laterally slidable on their respective stock check bars for varying the positions thereof and means for clamping said stock checks in positive position relative to said bars.

6. The apparatus of claim 4, said posts threadably connected to said frame and threaded adjusting means disposed on said posts between said frame and said lower bar for adjusting the position of said lower bar relative to said frame and said feed plane.

7. The apparatus of claim 6, said levers pivotally connected to said lower bar.

8. The apparatus of claim 4, including a lead-in roll assembly positioned forwardly of said stock brake assembly, said lead-in roll assembly comprising a lower roll positioned transversely beneath said feed plane wherein stock passing through said lead-in assembly is supported by said lower roll, an upper roll transversely positioned above said feed plane downstream from said lower roll and supported at opposite ends thereof within a bracket, said bracket in turn supported for pivotal movement about the axis of said lower roll such that said upper roll is movable towards and away from said feed plane so as to vary the vertical spacing between the upper surface of said lower roll and the lower surface of said upper roll whereby different thickness stock may pass between said rolls in a straight path and means for fixing the position of said bracket with respect to said frame.

9. A lead-in apparatus for positioning sheet stock for feed along a straight generally horizontally orientated feed plane to a device such as a press or the like, including a lead-in roll assembly positioned forwardly of said device, said roll assembly comprising a lower roll positioned transversely beneath said feed plane wherein stock passing through said lead-in assembly is supported by said lower roll, an upper roll transversely positioned above said feed plane downstream from said lower roll and supported at opposite ends thereof within a bracket, said bracket in turn supported for pivotal movement about the axis of said lower roll such that said upper roll is movable towards and away from said feed plane so as to vary the thickness of stock which may be passed straight through said roll assembly within said feed plane such that the lower surface of said upper roll contacts the upper stock surface as it moves therepast, and means for fixing the position of said bracket with respect to said frame.

10. The apparatus of claims 8 or 9, wherein said device includes a frame, a carriage mounted on said frame and adjustably movable towards and away from said feed plane, said carriage including forwardly extending laterally spaced flanges for simultaneously supporting said first roll and said bracket, said bracket having spaced arms, said means for fixing the position of said bracket including a slot in each of said arms, bolts supported by said flanges, said bolts passing through said slots and nuts associated with said bolts for clamping said arms in fixed position against said flanges.

11. The apparatus of claims 8 or 9, including a pair of laterally adjustable collars slidably mounted on said first roller, and means for clamping said collars on said roller in a laterally spaced position so as to enable said stock to pass therebetween with the opposite lateral edges thereof in contact with the inside surfaces of said collars.

* * * * *